United States Patent [19]

Whitlock

[11] 4,421,272

[45] Dec. 20, 1983

[54] SPLICING AND GRADE CROSSING CONSTRUCTION

[75] Inventor: Jacob O. Whitlock, Springfield, Ill.

[73] Assignee: Structural Rubber Products Company, Springfield, Ill.

[21] Appl. No.: 354,883

[22] Filed: Mar. 4, 1982

Related U.S. Application Data

[63] Continuation of Ser. No. 84,371, Oct. 12, 1979, abandoned.

[51] Int. Cl.[3] ..... E01C 9/04

[52] U.S. Cl. ..... 238/8; 403/292; 404/48; 404/64

[58] Field of Search ..... 238/1-3, 238/6, 8, 9; 404/32, 33, 40, 41, 47, 68, 69, 73, 48, 64; 14/16.5; 52/396, 402; 403/292, 294, 298

[56] References Cited

U.S. PATENT DOCUMENTS

| | | | |
|---|---|---|---|
| 1,783,274 | 12/1930 | Bell | 238/8 |
| 1,941,967 | 1/1934 | Bell | 238/8 |
| 2,067,037 | 1/1937 | Alexander | 238/8 |
| 2,828,079 | 3/1958 | Rennels | 238/8 |
| 2,854,194 | 9/1958 | Johnson | 238/8 |
| 3,824,644 | 7/1974 | Stranzinger | 404/40 X |
| 3,843,051 | 10/1974 | Whitlock | 238/8 |
| 4,093,120 | 6/1978 | Canfield | 238/8 |
| 4,117,977 | 10/1978 | Whitlock | 238/8 |

FOREIGN PATENT DOCUMENTS

| | | | |
|---|---|---|---|
| 2011822 | 3/1971 | Fed. Rep. of Germany | 404/68 |
| 2737190 | 2/1979 | Fed. Rep. of Germany | 404/40 |
| 260252 | 7/1949 | Switzerland | 404/60 |
| 1174962 | 12/1969 | United Kingdom | 404/60 |

*Primary Examiner*—Randolph Reese

*Attorney, Agent, or Firm*—Neuman, Williams, Anderson & Olson

[57] ABSTRACT

Anchoring bars are disclosed which are installed at the joint between surfacing modules laid end to end along or between a pair of rails in a railroad-highway grade crossing. The modules are of the elastomeric type. Each module is provided with an improved series of surface gutters of different depths with complementary spike wells extending into the elastomer to drain water away. The elastomeric surface layer of the modules is bonded to one or more reinforcing, corrugated steel subgrade surfacing members which cooperate with the anchor bars and the elastomeric layer to lock the modules together.

15 Claims, 14 Drawing Figures

FIG. 1
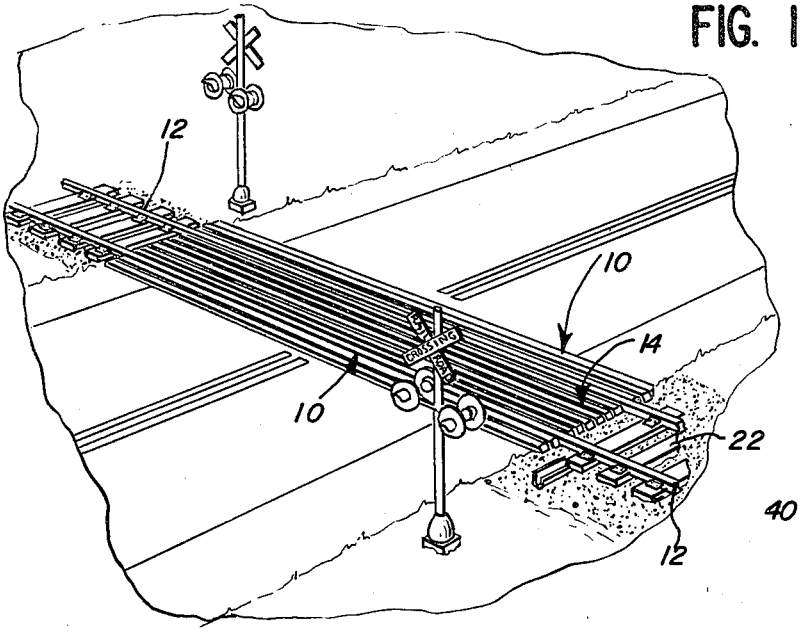
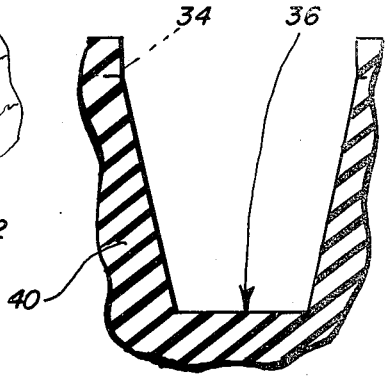
FIG. 4
FIG. 2
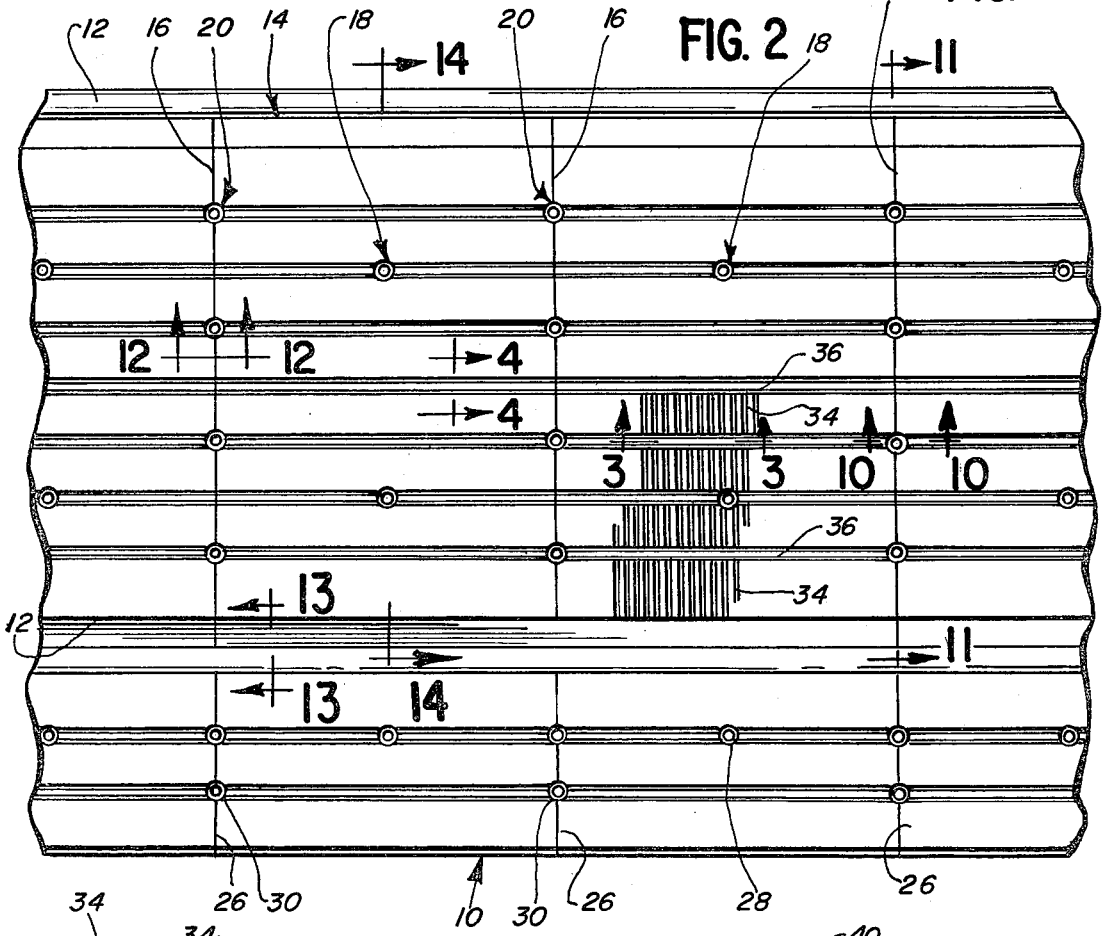
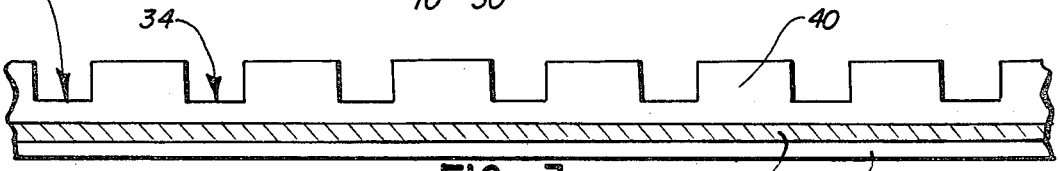
FIG. 3

SPLICING AND GRADE CROSSING CONSTRUCTION

This is a continuation of application Ser. No. 084,371 filed Oct. 12, 1979, now abandoned.

This invention relates to elastomerically surfaced railroad crossings. More particularly, it relates to joining together a series of surfacing modules in the crossing, and to the construction of the modules, to obtain lasting joints in making a crossing which will withstand heavy amounts of water and heavy highway and rail traffic.

Presently there are a number of types of joint constructions for elastomeric crossing modules. One is disclosed in U.S. Pat. No. 4,117,977 issued Oct. 3, 1978, to J. O. Whitlock. That patent discloses a steel tang plate welded in one module, underlapping an adjacent module. The two modules are pinned together with a common spike driven through a hole in one module and a hole in the tang plate which become aligned as the modules are placed end to end.

In another type of joint, half holes are formed in the ends of adjacent modules and are lined up when the modules are placed end to end. The adjacent modules are held in place by a spike with a large shoulder that engages both modules.

Other fastening constructions use parallel rows of spikes driven into the edges of modules which abut each other over the same railroad tie. The result is two parallel rows of spike insertions in the underlying tie.

Another joint construction is shown in U.S. Pat. No. 3,843,051 issued Oct. 22, 1974 to J. O. Whitlock. That patent discloses elastomeric modules reinforced with tubular members. Splines extend from within one set of tubular members into the open ends of other such members in an adjacent module. The ends of the tubes are placed so as to meet and abut over a supporting tie. Then spikes are driven through the tubes and splines into immediately neighboring ties on either side of the abutment tie.

In still another form of fastening construction for surfacing modules illustrated in U.S. Pat. No. 4,093,120, issued June 6, 1978 to David L. Canfield, metal plates are fastened to ties spaced apart from each other and separated by a number of other ties located along the crossing. Tensioning rods which are connected to the plates are intended to support the modules above and along the ties.

Use of the foregoing crossing combinations has demonstrated varying degrees of success in attempting to accomplish several objects of elastomeric crossing constructions. Use of these combinations has also revealed that further improvements are needed and desirable.

It is an object of this invention to provide an anchoring means between the surfacing modules in the crossing which may be inserted and removed from between any of the modules which are intermediate the end modules without disturbing the end modules themselves or even disturbing other modules adjacent to the one being removed.

It is another object of this invention to anchor a pair of surfacing modules to the underlying wooden shims or ties with a single row of spike fasteners in a given shim or tie, thus reducing the number of penetrations which have to be made into the shim or tie, or into the whole number of shims or ties in the crossing.

It is another object of this invention to provide an anchoring member which will lock into engagement with a pair of modules but which will not require connection to either of them prior to installation in a crossing.

It is another object of this invention to provide an interlocking engagement between an anchoring bar and a pair of modules such that the bar is positioned in the modules by movements which are not antagonistic to and may not be counteracted by the movements of the modules resulting from heavy rail traffic or heavy vehicular traffic over the crossing.

It is another object of this invention to provide a combination of modules of reduced weight and material, together with anchors to hold them in place in a crossing.

It is another object of this invention to provide a combination of elastomeric modules and anchoring bars which utilizes the elastic properties of the elastomer for holding the bars in place.

It is still another object of this invention to provide a combination of elastomeric modules and anchoring bars which permits the modules to be splayed in a radial relationship to each other in forming the surface of a crossing wherein the railroad tracks form a curve.

These and yet additional objects and features of the invention will become apparent from the following detailed discussion of an exemplary embodiment, and from the attached drawings and appended claims.

In a railway crossing which includes a pair of substantially parallel rails, a preferred form of the invention comprises a pair of railway crossing surfacing modules adjoining each other and at least one anchor bar extending between and engaging each of them. Each module includes a web portion positioned between the rails, extending from rail to rail. Each web includes a plurality of module gutter portions having end portions meeting each other to form continuous, relatively deep gutters in the webs parallel to the rails. In at least two of the meeting gutter portion ends, pockets are incorporated which are adapted to receive and engage portions of the anchor bar. The anchor bar itself includes an elongated body portion having one end disposed in the pocket at the end portion of one gutter end and the other end disposed in the pocket of the meeting end portion of the other gutter.

BRIEF DESCRIPTION OF THE DRAWINGS

For a complete understanding of this invention, reference should be made to the accompanying drawings in which:

FIG. 1 is a perspective view of a railway grade crossing which includes a view of a portion of the highway intersecting the railway;

FIG. 2 is a plan view of a portion of the railway crossing shown in FIG. 1, on an enlarged scale, illustrating a portion of the gage surfacing modules between the rails and a portion of the field surfacing modules outside of one of the rails;

FIG. 3 is an elevational view of a cross-section of a series of primary gutters on the surface of a portion of one of the gage modules shown in FIG. 2, on an enlarged scale, taken along the lines 3—3 in FIG. 2;

FIG. 4 is an elevational view partly broken away of a cross-section of a secondary gutter on the surface of a portion of one of the gage modules shown in FIG. 2, on an enlarged scale, taken along the lines 4—4 in FIG. 2;

DETAILED DESCRIPTION OF THE PREFERRED EMBODIMENT

Figure 5:
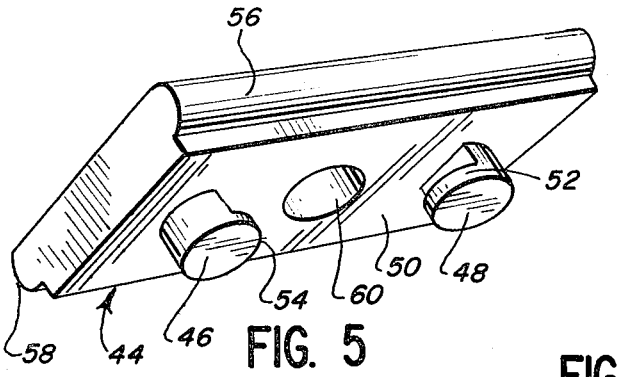
FIG. 5 is a perspective view, on an enlarged scale, of an anchor bar of the present invention used in joining the modules shown in FIG. 2.

In the railroad crossing which is shown in FIG. 1, the crossing is surfaced by a plurality of elastomeric modules. A plurality of the field modules 10 is placed alongside the railroad tracks or rails 12, outside each of the parallel rails. Between the rails gage modules 14 are located in such a manner, shortly to be described, that the rails 12 are sandwiched between the edges 16 of the gage modules and the edges 26 of the field modules. The edges 16 of the gage modules, which are perpendicular to the rails, abut each other along the length of the crossing. At various points in the gage modules, wells 18 and 20 for spikes or other fasteners are formed for fastening the modules to railroad ties such as 22 which support the rails 12 beneath the crossing 10. Depending upon the height of the rails above the ties, such well known mechanical devices as shims 24 (see FIGS. 10–11 and 13–14) may be used to support crossing modules so that they are level with the top surface of the rails. In the latter event, the fasteners would extend into the shims, too.

The field modules 10 are quite similar to the gage modules 14 and are assembled in the crossing in an almost identical manner as the assembly of the gage modules. The edges 26 of the field modules which are perpendicular to the rails 12 abut each other, as shown in FIG. 2, and wells 28 and 30 for spikes or other fasteners are formed in the modules to accept such fasteners in order to secure the field modules to underlying ties 22 or shims such as 32 (see FIG. 13).

Because the gage modules and field modules in the present invention are so similar, the discussion hereafter, while put in terms of the gage modules, should be understood to apply also to the field modules.

The upper, tread surface 40 of the gage modules, that is, the surface which comes in contact with the tires of vehicular traffic passing over the crossing, is furrowed with gutters, some of which are shown in FIG. 3, and an example of another is shown in FIG. 4. The gutters shown in FIG. 3, which are numbered 34, may be called primary gutters in that they are disposed over much more of the surface of each module than the secondary gutters 36 which are shown in FIG. 4. Also, the primary gutters 34, as shown in FIG. 2, are arranged, preferably perpendicularly, to intersect and empty into the secondary gutters 36. It has been found helpful, for example, to form the primary gutters 34 in the surface of the gage module about ¼ inch deep, while the secondary gutters 36 are formed about 1-13/16 inches deep from the top surface of the module. The difference in depth may be seen in FIG. 4 between the primary gutters and the secondary gutters, the ends of two primary gutters being shown there in phantom. As illustrated in FIGS. 1 and 2, the secondary gutters 36 are preferably arranged parallel to the longitudinal direction of the tracks so that the water collected by the secondary gutters from the primary gutters may be drained away at a level below the top surface of the modules to the outer ends of the railroad crossing.

The gage modules 14 are formed of an elastomeric material bonded to a pair of corrugated steel plates, one of which is shown in cross-section as plate 38 in FIG. 3. The upper surface of the module which is exposed to the wheels of vehicular traffic coming over the crossing is tread surface portion 40 in which the primary gutters 34 are formed. The opposite layer in the module, which surfaces the subgrade below the crossing, principally consists of the steel plate 38, whch may be protected by a thin layer 42 of an elastomeric substance. It will be apparent from comparing FIG. 3 with FIGS. 9, 10 and 14 that the steel plate 38 is formed in a corrugated manner whereby a thin layer of elastomer 42 protecting the subgrade surfacing layer follows the corrugations; also, a relatively thick layer of the elastomer in tread surface layer 40 is molded about the corrugations to provide not only the numerous primary gutters 34 which afford good, dry traction to vehicular traffic, but also the deeper, secondary gutters 36 in the valleys of the corrugations in plate 38 to carry substantial amounts of water off the crossing.

A plurality of anchoring bars 44, such as shown in FIG. 5, are used to join modules 14 together. In practice, an anchor bar is used to span each of the spike wells 20 at the module edges 16 which are normal to the rails. An identical anchor bar is used to span the spike wells 30 in the field modules. A preferred form of anchoring bar is shown in FIG. 5. It includes first and second engagement pins 46 and 48, respectively, extending outwardly from opposite ends of an anchor bar body portion 50. Means are arranged on each of the pins for engaging the adjacent edges of a railroad crossing surfacing module and an adjacent surfacing module. In the illustrated, preferred form of bar, each of the engagement pins includes a detent such as detent 52 at the outer end of pin 48 and a similar detent 54 at the outer end of pin 46. Also, the anchor bar includes a flat body portion 50 which may be engaged, in a manner shortly to be described, in a pocket formed in the elastomeric tread surface layer of the module. The edge portions of the bar 44, shown at 56 and 58 in FIG. 5, protrude outwardly from and overlie the engagement pins 46 and 48, and thus are engageable upon the module at locations which are spaced apart from the pins. Also, an aperture 60 is formed in the body portion of the bar adjacent the pins, through which a fastening means such as a spike may be positioned to affix the anchor bar to a railroad tie underlying the railroad crossing. As illustrated, the aperture 60 is formed in the middle of the anchoring bar, between the pins, so that a spike driven down upon the anchoring bar will exert equal pressure on the pins at either end of the bar. In this manner a single spike may be used to fasten the ends of both modules together and to an underlying tie, thereby positively engaging both modules but reducing the number of spikes which would otherwise be used.

Figure 8:
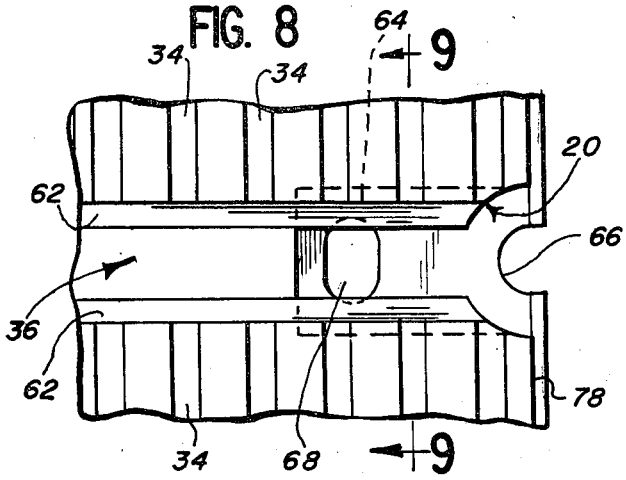
FIG. 8 is a plan view, partly broken away, of the end of a module incorporating an anchor bar pocket as shown in FIGS. 6 and 7.
Figure 9:
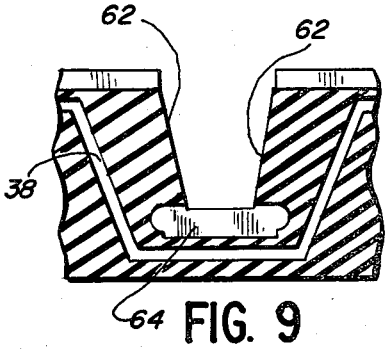
FIG. 9 is a sectional view of the anchor bar pocket shown in FIG. 8, taken along the lines 9—9 in FIG. 8.

FIGS. 8 and 9 illustrate a pocket for receiving an anchor bar formed in the end of a secondary gutter in the module. The secondary gutter 36 includes sloping sides 62 in the elastomer which overhang a hollowed-out portion 64 adjacent the edge of the module. Each side of the hollowed-out portion 64 is adapted to fit the edges of the anchor bar 56 and 58, and the lowermost portions of the sloping sides 62 are adapted to rest on the flat, upwardly facing surface of the anchor bar, whereby the upper side of the pocket is substantially closed and edges of the bar are held in a locking engagement in the end of the secondary gutter.

In the preferred form of construction, a half-round cut-out section 66 is constructed at the edge of the module (see FIG. 8). When two modules are placed together, edge-to-edge, the cut-out sections 66 form apertures which coincide with the disposition of aperture 60 in the anchor bar, thus creating a common channel to receive a fastening means such as a spike 74 (see FIG. 10). It has also been found desirable to construct an eliptical aperture 68 in the pocket 64, to extend into, and preferably through the tread surface layer 40 of the elastomer and through the corrugated metal plate 38. A pin, such as the pin 46, extending from the body of an anchor bar can be worked into position through aperture 68 to further engage the anchor bar on the edge portion of the module. The eliptical shape of the aperture 38 permits a rotation of the anchor bar about its longitudinal axis and leaves room for the length of the pin to pass the edges of the aperture 68.

Figure 10:
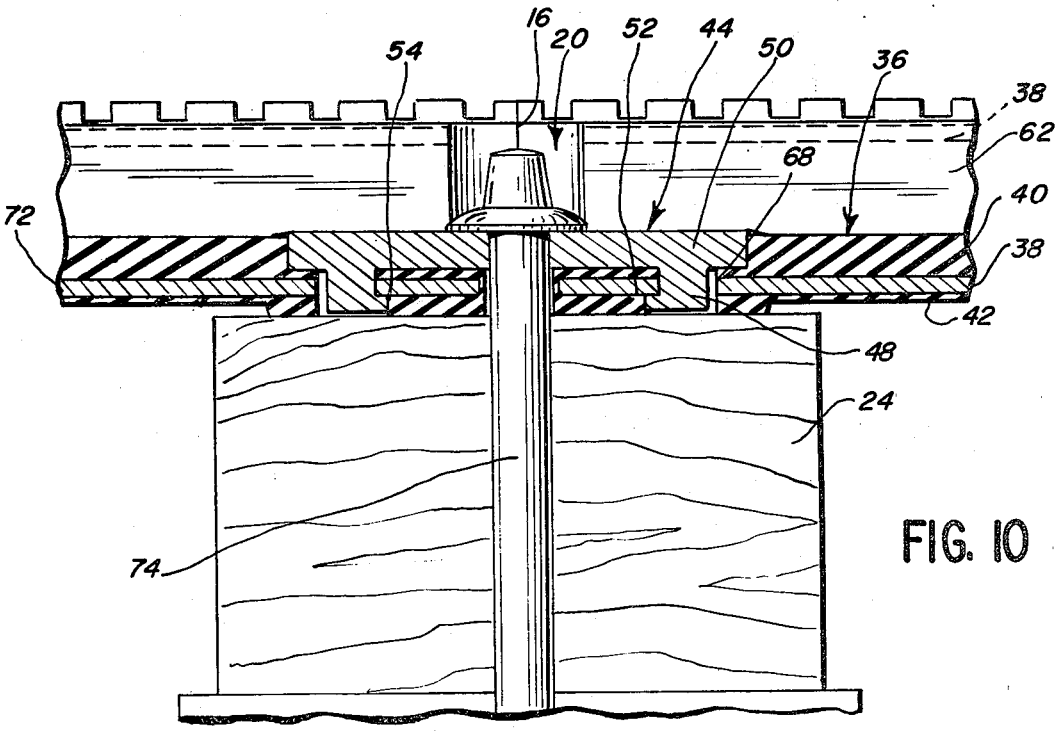
FIG. 10 is a sectional view, on an enlarged scale, of an anchor bar fastened into the pockets at the ends of adjacent modules and onto an underlying railroad supporting timber, taken along the lines 10—10 in FIG. 2.

In assembled relationship, as shown in FIG. 10, the anchor bars such as bar 44 are disposed at the ends of secondary gutters 36. The sides 62 of the gutter rest on the top and engage the anchor bar body portion 50, and the engagement pins, such as pin 48, extend through aperture 68 to lock the anchor bar securely in place. It will be noted that there are two separate points of engagement of the bar, namely, the body portion in the pocket, and the pin in or through the aperture. A further, locking engagement may be achieved, but it will be useful first to explain the manner of installing the anchor bar illustrated in the drawing.

Figure 6:
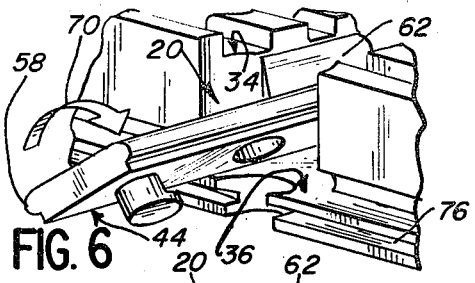
FIG. 6 is a perspective view partly broken away of the anchor bar shown in FIG. 5 partially disposed in a pocket formed in the end of a module.
Figure 7:
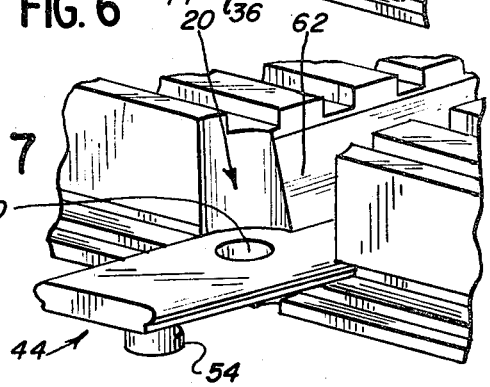
FIG. 7 is a perspective view partly broken away of the anchor bar and module pocket shown in FIG. 6 after the anchor bar has been fully positioned in the pocket by moving it in the direction indicated by the wide, curved arrow in FIG. 6.

The manner of placing the anchor bar in position is illustrated in FIGS. 6 and 7. One side, 58, of the anchor bar body portion is placed in gutter 36 below the lip of sloping side 62 in an edge of pocket 64. A pry bar (not shown), or other such lever type device, is inserted in aperture 60 so that the body portion of the anchor can be forcibly rotated in the direction of arrow 70 (see FIG. 6). Since the tread surface portion in which the gutter and pocket are formed is an elastomeric material, the lever can achieve entry of the anchor bar into the pocket, and it can be seated in place, as shown in FIGS. 7 and 10.

The modules may be further secured, as particularly illustrated in FIG. 10, by engagement of the detents 52 and 54 on the steel reinforcing corrugated plate 38 and its identical counterpart plate 72 in an adjacent gage module. To achieve such engagement, the edges 16 of one module are compressed, as by the use of an hydraulic jack, against the edges of the adjacent module, and then the anchor bar is twisted into seating engagement, as above described. The pressure exerted by the jack is then released so that the compression of the elastomer is relaxed sufficiently enough to permit the edges of aperture 68 and their counterpart to move apart from each other, thereby slipping the steel plates into locking engagement on each of the detents 52 and 54.

Thereafter, aperture 60 may be utilized as a template for drilling a hole into a subtending supporting structure such as shim 24, whereupon a spike 74 may be inserted in the hole through spike well 20 and driven down to fasten the modules in place over a railroad tie.

It should also be noted, as seen in FIGS. 6–7 and 11–12 that the edges of the modules which are held together by the anchor bar are provided with a tongue and groove pair of complementary mating portions 76 and 78 which are compressed tightly together when pressure is exerted by the hydraulic jack and which remain in close, water-tight sealing engagement when the pressure of the jack is removed.

To separate the modules, a reversal of the procedure described above is followed, namely, a pressing of the modules together with a jack or similar instrument, withdrawal of the spike 74, and a rotation of the anchor bar out of engagement by using a pry bar. This disengagement of the anchoring bars can be done even in modules which are intermediate the ends of a crossing without disturbing the continuity of the surface formed by the rest of the modules in the crossing. As seen in FIG. 2, the spike wells 18 are similar to the wells 20, but are not formed at the adjoining edges of the modules and do not contain anchor bars. In order to disengage an intermediate module, spikes from a pair of wells 18 may be withdrawn from two adjoining modules and thereafter the pintles of a jack may be inserted in the spike holes. The jack may then be operated to pull adjoining modules together and compress the edges of the modules at 16, thereby permitting removal of the anchor bars at the edges of the adjacent modules. When the anchor bars are removed around both sides of the module, it may be simply lifted up and taken away. Another may be installed in its place with a minimum of disturbance to the crossing.

Figures 11, 12, 13, 14:
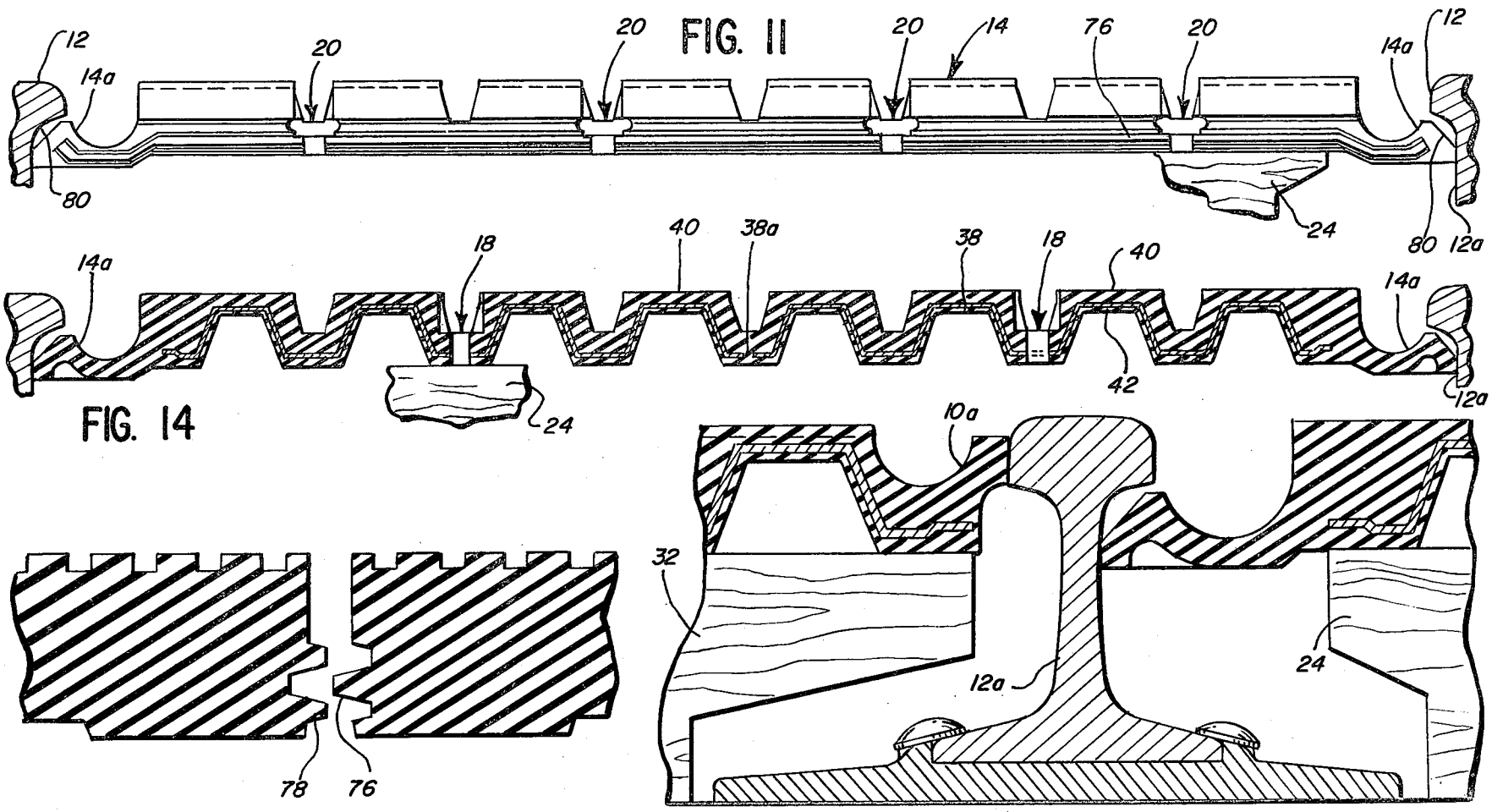
FIG. 11 is an end elevational view of a railway crossing gage module identical to the module end designated at lines 11—11 in FIG. 2, but without anchor bars or fasteners in or extending through the module, the module being positioned between but not operatively disposed against two rails which are partly broken away.
FIG. 12 is an enlarged sectional view partly broken away of the ends of two modules, just prior to being fully engaged at the place designated by lines 12—12 in FIG. 2.
FIG. 13 is an enlarged sectional view partly broken away of a rail sandwiched between the edge portion of a field module and the edge portion of a gage module at the place designated by lines 13—13 in FIG. 2.
FIG. 14 is a sectional view in elevation of a railway crossing gage module identical to the module section designated at lines 14—14 in FIG. 2, but without fasteners in the module, and the module being positioned between but not operatively disposed against two rails which are partly broken away.

The modules 14, as shown in FIG. 11, are provided with tongue and groove edge faces which engage each other, as described above. The gage modules 14, themselves each including a web portion extending from rail to rail, form a crossing sized web between the rails 12 substantially impervious to moisture such as rain or melting snow. As shown in FIG. 11, the rails and modules are shown in an unnatural spaced apart relationship in order to illustrate the relaxed configuration of the module edge portions which abut the rails. The edge portions **14*a*, which are adapted to engage the upright web portions of the rails may be seen to be formed with beveled surfaces 80 at the outer extremities of the modules. These beveled edges are adapted to be forced against the rails and form a sealing engagement with the web portions of the rails and any rough formations of the underside of the rail head which may exist in normal practice. In a preferred form of the web, the edge portions 14***a* and beveled surfaces 80 are disposed in an unsupported relationship beyond the shim 24 and rest only against the upright webs of the rails, thereby permitting substantial flexibility and sealing engagement of the module against the rails. While the face of the edge portions 14*a*, as shown in FIG. 11, is provided with a tongue and groove engagement surface to mate with an adjacent module, FIG. 14 illustrates the high degree of flexibility of edge portion 14*a* in that such edges are formed along most of their length with a serpentine cross-section. Also, the reinforcing steel plate 38 does not extend into the edge portions 14*a*. A similar construction is illustrated in FIG. 13 for edge portion 10*a* of a field module 10. The edge portion 10*a*, however, is forced into sealing engagement on the rail head above the web portion 12*a* of the rail.

The steel corrugated reinforcing plate 38 shown in cross-section in FIG. 14, may be formed in two parts so that each part is hinged to the other by the elastomer, as shown at the hinge 38*a* in FIG. 14. Installation of the gage module between the rails is thereby facilitated, in that the central portion of each module, in the vicinity of the hinge 38*a*, may be flexed and lifted slightly from the subgrade, the edge portions 14*a* may then be placed below the rail heads and in contact with the web portions 12*a* of the rails, and thereafter pressure can be exerted on the tread surface 40 to press the entire module level with the top surface of the rail heads, thus forcing the edge portions 14*a* to be distorted by moving into sealing engagement on the rails.

It will be apparent from an examination of the construction of the preferred embodiment described above that the modules need not be joined together with anchor bars in an absolutely straight line. Accordingly, a substantial track curvature in a grade crossing can be accommodated. The elastomeric edges of the modules may be pressed together more tightly adjacent one rail than at the other rail, and anchor bars of different lengths may be used whenever the plan of the crossing dictates. In such an organization, therefore, the modules may be splayed in a radial orientation to each other to adapt to rail curvature in the crossing.

Thus, it will be seen that improvements have been provided in the constructions intended for use in elastomeric, grade crossings and in the splicing construction between elastomeric modules in such crossings, thus meeting the afore-stated objects of the present invention.

While a particular embodiment of the present invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A railway crossing surfacing module comprising a web of elastomeric material positionable against a rail and extending normally toward each one of a pair of rails, a plurality of gutter portions in the web, some of the gutter portions extending parallel to the rails and some of the gutter portions extending parallel to the edges of the web normal to the rails;

at least one of the gutter portions including a pocket formed adjacent a web edge normal to the rail and having side walls recessed into the elastomeric material on opposite sides of the gutter;

a first aperture formed in the web at the end of the gutter portion containing the pocket spaced apart from the web edge and extending from the bottom of the pocket into the elastomeric material, the portion of the web forming the aperture being movable toward the web edge by compression of the elastomeric material between the web edge and the aperture, and movable away from the web edge by expansion of the elastomeric material between the web edge and the aperture following compression of the elastomeric material, a tread surface portion of the web adapted to engage the wheels of vehicles passing over the crossing and an opposite subgrade surface portion facing the ties beneath the rails, and a second aperture formed in the edge of the web adjacent the gutter end containing the pocket and extending from the tread surface portion through the subgrade surface portion, said second aperture being spaced apart from the first aperture and adapted to receive a fastening rod extending through the edge of the web into the ties.

2. The railway crossing module of claim 1 in which the edge portion of the web forming the second aperture includes an enlarged diameter upper portion of the second aperture disposed in the tread surface portion of the web adapted to receive an enlarged portion of the fastening rod intermediate the tread surface and the bottom of the pocket, and a smaller diameter lower portion adapted to receive a portion of the fastening rod of lesser diameter through the subgrade surface portion of the web.

3. The railway crossing surfacing module of claim 1 in which the edge portion of the web forming the second aperture is shaped to interfit the edge portion of a similar web the second aperture being formed in and partially surrounded by each of the interfitting edge portions of the web and of the similar web.

4. The railway crossing surfacing module of claim 1 in which the subgrade surface portion forms a second aperture adjacent the web edge coinciding with the location of the second aperture in the web adapted to receive a fastening rod extending into a railroad tie below the module, the second aperture being formed in the subgrade portion at the nadir of a contour which is adapted to be disposed closest to the ties.

5. In a railway grade crossing including a pair of substantially parallel rails, the combination comprising a pair of railway crossing surfacing modules adjoining each other, and at least one anchor bar extending between and engaging each of the adjoining modules, each module including a web of elastomeric material positionable against one of the rails and extending normally toward each rail in the pair;

a plurality of gutter portions in the web, some of the gutter portions extending parallel to the rails and some of the gutter portions extending parallel to the edges of the web normal to the rails;

at least one of the gutter portions including a pocket formed adjacent a web edge normal to the rail and having side walls recessed into the elastomeric material on opposite sides of the gutter;

a first aperture formed in the web at the end of the gutter portion containing the pocket spaced apart from the web edge and extending from the bottom of the pocket into the elastomeric material, the portion of the web forming the aperture being movable toward the web edge by compression of the elastomeric material between the web edge and the aperture, and movable away from the web edge by expansion of the elastomeric material between the web edge and the aperture following compression of the elastomeric material, the gutter portion including the pocket being disposed contiguously to a like gutter portion including a like pocket and first aperture in the other module, the gutters in each module meeting in end to end relationship, and the anchor bar including an elongated body portion having one end disposed in the pocket at the end portion of one gutter in one module and the other end disposed in the like pocket in the meeting end portion of the meeting gutter in the other module, a first engagement pin adjacent one end of the anchor body portion extending outwardly therefrom and engaged in the first aperture formed in the bottom of the pocket in one module, and a second engagement pin adjacent the other end of the anchor body portion extending outwardly therefrom and into the first aperture in the bottom of the pocket in the other module.

6. The railway crossing combination of claim 5 which includes a fastening rod extending through the modules and the anchor bar intermediate the engagement pins into a crossing support member beneath the modules.

7. The railway crossing combination of claim 5 which includes a detent on the outer end of each of the engagement pins of the anchor bar extending into the first aperture in each module to engage an edge portion of the web in each of the modules adjacent the respective first apertures.

8. The railway crossing combination of claim 5 which includes a detent on the outer end of each of the engagement pins of the anchor bar extending into the first aperture in each module to engage a reinforcement element embedded in each of the modules.

9. The railway crossing combination of claim 5 which includes a detent on the outer end of each of the engagement pins of the anchor bar disposed in elements of the modules, said elements being movable in response to compression and subsequent expansion of the elastomeric material of the web connected to said elements and into locking engagement on the detents.

10. The railway crossing combination of claim 5 in which the first and second engagement pins are rigidly affixed to the anchor body portion and are fixed against walls of the first apertures in the modules by compression and subsequent expansion of the elastomeric material in the modules urging the modules apart.

11. The method of joining an adjacent pair of railroad crossing surfacing modules which incorporate an upper tread surface portion of elastomeric material and a pair of pockets adjacent the edges of the modules which meet each other with an anchor bar extending from one pocket to the other and including engagement means extending outwardly from the body portion of the bar which comprises:

forcing the modules together by compressing one module against the other before installing the anchor bar, positioning a first edge of the anchor bar in an edge of each of the pockets, rotating the anchor bar in a direction about said first edge to dispose a second edge of the bar opposite the first edge in another edge of each of the pockets, disposing the engagement means in the elastomeric material during rotation of the bar, and releasing the compression after the anchor bar is installed, whereby the resilient expansion of the elastomeric material to the modules urges the modules into continuous engagement on the engagement means of the anchor bar.

12. The method according to claim 11 which includes disposing the engagement means in apertures extending into the elastomeric material of the tread surface portion during rotation of the bar.

13. The method according to claim 11 which includes disposing the first edge of the anchor bar parallel to the direction of the railway rails at outer edges of the surfacing modules, and rotating the anchor bar for installation in the pockets in a direction normal to the rails.

14. The method according to claim 11 which includes disposing the anchor bar in the pockets of the modules at a distance spaced apart from the outer surface of the uppwer tread surface portion of the module.

15. The method according to claim 11 which includes inserting a fastening rod through the anchor bar and the modules into a crossing support member beneath the modules after the compression upon the modules has been relaxed.

* * * * *